US006880363B2

(12) United States Patent
Ma

(10) Patent No.: US 6,880,363 B2
(45) Date of Patent: Apr. 19, 2005

(54) CONNECTING STRUCTURE FOR A MULTIPLE-STRAND JEWELRY

(76) Inventor: Tien-Chi Ma, 3F-2, 150, Section5, Min Sheng East Road, Taipei (TW)

( * ) Notice: Subject to any disclaimer, the term of this patent is extended or adjusted under 35 U.S.C. 154(b) by 31 days.

(21) Appl. No.: 10/407,470

(22) Filed: Apr. 7, 2003

(65) Prior Publication Data

US 2004/0194502 A1 Oct. 7, 2004

(51) Int. Cl.[7] ..... A44C 5/00
(52) U.S. Cl. ..... 63/3.1; 63/35
(58) Field of Search ..... 63/3, 3.1, 3.2, 63/4, 35

(56) References Cited

U.S. PATENT DOCUMENTS

| | | | | | |
|---|---|---|---|---|---|
| 1,044,686 | A | * | 11/1912 | Osmers | 24/685 |
| 1,622,770 | A | * | 3/1927 | Coombs | 63/4 |
| 1,813,963 | A | * | 7/1931 | Schick | 24/616 |
| 2,090,789 | A | * | 8/1937 | Forstner | 2/339 |
| 2,266,074 | A | * | 12/1941 | Rauer | 24/616 |
| 2,529,058 | A | | 11/1950 | Tell et al. | |
| 2,586,758 | A | | 2/1952 | Zerr | |
| 2,598,597 | A | | 5/1952 | Philippe | |
| 2,644,992 | A | | 7/1953 | McFarland | |
| 2,893,095 | A | * | 7/1959 | Dohn | 24/265 R |
| 3,098,364 | A | | 7/1963 | Verri | |
| 3,135,031 | A | | 6/1964 | Brosse | |
| 3,208,238 | A | | 9/1965 | Spitzer | |
| 3,225,406 | A | * | 12/1965 | Levy | 24/616 |
| 4,527,316 | A | | 7/1985 | Murphy | |
| 4,549,411 | A | | 10/1985 | Ivey | |
| 4,628,708 | A | | 12/1986 | Ivey | |
| 4,648,161 | A | | 3/1987 | Rosen | |
| 4,651,541 | A | * | 3/1987 | Farley | 63/1.16 |
| 5,351,505 | A | * | 10/1994 | Febrer | 63/3.1 |
| 5,369,854 | A | * | 12/1994 | Stephens | 24/587.11 |
| 5,410,784 | A | | 5/1995 | Katz | |
| 5,572,887 | A | * | 11/1996 | Geswelli | 63/3 |
| 6,256,793 | B1 | | 7/2001 | Arias et al. | |
| 6,477,752 | B1 | * | 11/2002 | van der Greft | 24/599.1 |
| 6,519,778 | B1 | * | 2/2003 | Arias et al. | 2/207 |

OTHER PUBLICATIONS

Rudolph Neumann GmbH & Co. KG, "Metallschliessen Clasps in Base Metal", Catalog, pp. 1–27.
Rudolph Neumann Gmbh & Co. KG, "Ketten–Clipse Enhancers", Catalog, pp. 1–2.
Rudolph Neumann GmbH & Co. KG, "Kollierzubehor Necklace Accessories", Catalog, pp. 1–2.

* cited by examiner

*Primary Examiner*—Robert J. Sandy
*Assistant Examiner*—Thomas Ho
(74) *Attorney, Agent, or Firm*—Kao H. Lu

(57) ABSTRACT

A connecting structure that gathers the ends of a plurality of chains or strands made of pearls or other ornamental beads to form a jewelry necklace. The connecting structure positions and retains the strands in a stacked arrangement when the necklace is donned on the neck of a person. The connecting structure has two sets to form a pair. Each set comprises a front side and a rear side. The front side includes at least two outlets evenly spaced apart longitudinally along the front side to provide connection to the ornamental strands, and the rear side has a rearward-extending terminal located below the longitudinal median of the connector. The terminals of the two sets are pivotally engaged with each other.

6 Claims, 8 Drawing Sheets

CONNECTING STRUCTURE FOR A MULTIPLE-STRAND JEWELRY

BACKGROUND OF THE INVENTION

1. Field of Invention

The present invention relates to a connector that gathers the ends of a plurality of ornamental jewelry for encircling a member of human body, such as necklaces, bracelets, watchbands and armbands.

2. Description of the Prior Art

Chokers are 15 to 17 inches long necklaces worn at the base of the neck of a person. One aesthetically pleasing means of wearing a multiple-strand choker is to make the strands draping in front of the neck parallel and adjoined to one another in "a stacked arrangement", as shown in FIG. 3. In order to attain a stacked arrangement, the choker has to fit the contour of wearers' neck. The shape of people's neck is substantially a truncated cone at the base, and gradually becomes a tube at the throat portion. To fit the shape of the cone, the length of an upper strand must be shorter than the lower strand. As the slope of the cone increases, the required relative difference between the lengths of the strands decreases.

When a person with a thick neck wears a multiple-strand necklace of a medium size, the necklace would fit at a higher portion of the neck, where the slope is steeper, thus the strands tend to separate from one other, as shown in FIG. 1A. When a person with a thin neck wears the same necklace, the necklace slides to the base of the neck, where the slope of the neck is smaller, thus the strands overlap with one another as shown in FIG. 1B. Although extenders are commonly used to adjust the necklace to fit the size of the neck, they can not adjust the strands to fit the contour of the neck.

U.S. Pat. No. 2,529,058 disclosed a device to set the length of each strand in a multiple-strand necklace to attain a better fit. But the finished necklace still has to be custom-made and cannot fit a variety of neck contours.

U.S. Pat. No. 2,644,992 disclosed a clasp, which claims the ability to adjust the distance between parallel beaded chains. However, the adjustment is made to the distance between the ends of the adjacent strands, and has limited effect in adjusting the distance between the portions of the strands that drapes in front of the neck.

Furthermore, the strands in a choker are easily displaced due to flexing of neck muscles or changes in body posture, such as movement of the shoulders or the head. A choker that is carefully fitted to the neck may not be able to retain the stacked arrangement. Ideally, the choker should resume a neatly stacked arrangement when the wearer engages in moderate physical activities.

Dividers are commonly used on the sides of multiple strand chokers to keep the strands adjoined and to fix their relative positions to maintain a neatly arrayed arrangement. However, chokers incorporating the separators still have to be custom made, and they are often not aesthetically desirable.

Wearing a short multiple-strand choker, known as "collars", snugly around the throat also produces an aesthetically pleasing effect. Such choker also has to fit comfortably and shapely about the neck. The effect is lost should the strands sag or overlap with each other.

U.S. Pat. No. 2,598,597 disclosed an elastic connector for multiple-strand chokers that employs a set of springs to accommodate variation in the size of wearer's neck and prevent the choker from slipping down. However, a pressure is applied to the neck when an elastic means is used, and the wearer could suffer from an irritable stifled feeling at the throat.

Another means employed in the prior art to keep collar fit snugly around the neck is to use elastic strings. However, the strands have to be pulled very tightly around the neck to prevent from sliding down, thus causing discomfort. Moreover, the strings often lose their elasticity after repeated use.

Although multiple-strand chokers and collars are very popular jewelry, they could not be purchased off-the-shelf and expected to fit the contour of the neck featuring stacked arrangement effect, nor could they be confidently purchased through printed or electronic media when fitting is not possible before ordering.

SUMMARY OF THE INVENTION

In view of the abovementioned disadvantages relating to multiple strand chokers, it is an object of this invention to provide a connector that enables a multiple-strand choker to fit a greater population of wearers with various neck contours.

It is another object of this invention to incorporate the connector in a "collar" type choker that does not slide down, as well as fit snugly and comfortably about the neck of the wearer in a stacked arrangement without using elastic means.

The construction of a multiple-strand necklace basically consists of a plurality of ornamental strands, having their two ends connected to the outlets of a pair of connectors. And the terminals of the connectors, which are located latitudinal across the outlets, are linked to a set of clasp that detachably secures the connectors to each other when the necklace is encircled around the neck.

It has been found that the multiple-strand chokers and collars can readily establish a stacked arrangement provided that the up-lifting force applied to the strands progressively decreases from the bottom strand to the top strand when these necklaces are encircled around the neck. Therefore, each strand acts a ledge for its upper strand. In other words, the strands are piled upwardly from the bottom strand.

The mechanical means of facilitating the result of this finding is using the connectors as levers to balance the down pull moment of the strands exerting on the connectors. The down pull moment of each strand acting on its respective outlet is proportional to the down pull force of the strands times the distance from the outlet to the terminal. Thus, by locating the terminals below the longitudinal median of the connectors, further away from the top strand and closer to the bottom strand, the down pull moment about the terminal increases from the bottom strand to the top strand. Due to an equal and opposite reaction, the resulting up-lifting force applied to the strands decreases from the bottom strand to the top strand.

The preferred embodiments of the present invention and the mechanism of facilitating the stacked arrangement will be explained in greater detail in the following description with reference to the accompanying drawings:

DETAILED DESCRIPTION OF THE PREFERRED EMBODIMENTS

Figure 1A:
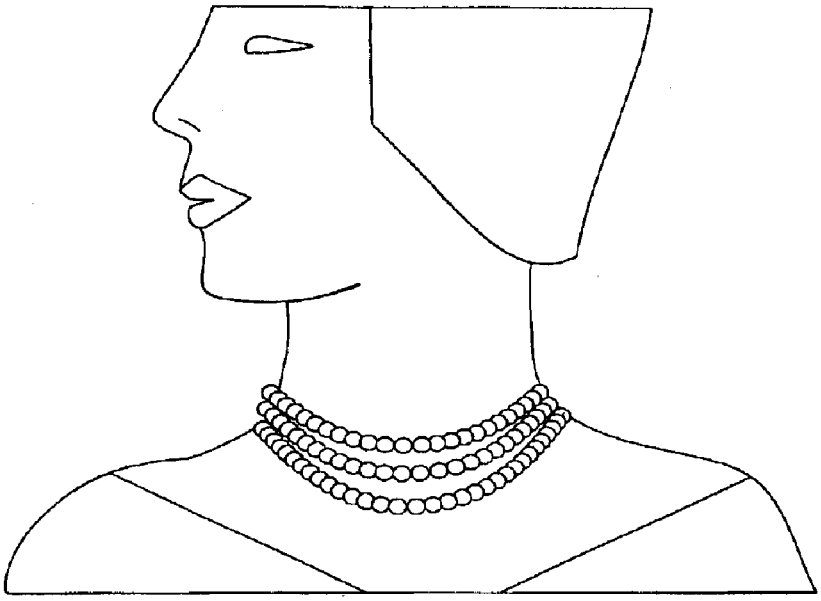
Fig. 1A (prior art)
FIG. 1A is a front view of a conventional multiple-strand chokers having the strands separated.
Figure 1B:
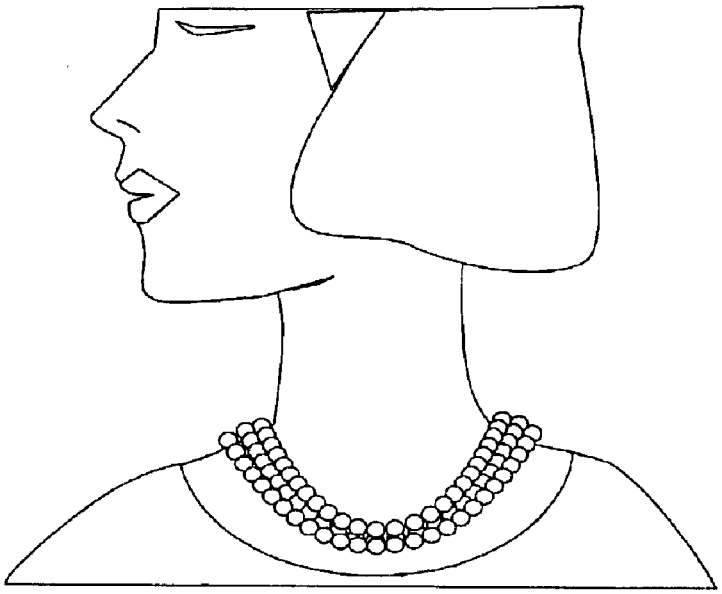
Fig. 1B (prior art)
FIG. 1B is a front view of a conventional multiple-strand choker having the stands overlapped.
Figure 2:
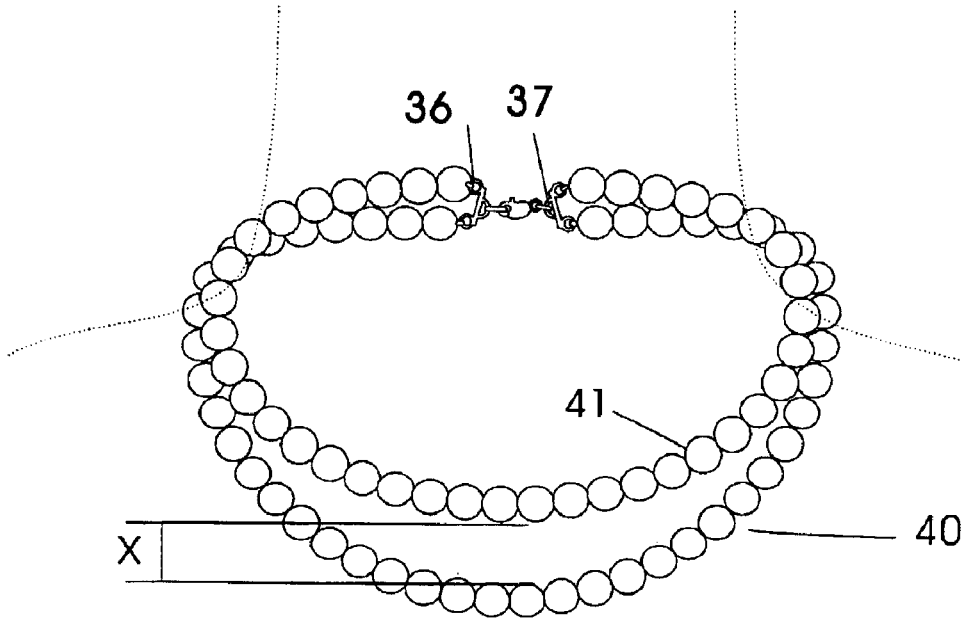
Fig. 2 (prior art)
FIG. 2 is an illustration of a prior art.
Figure 3:
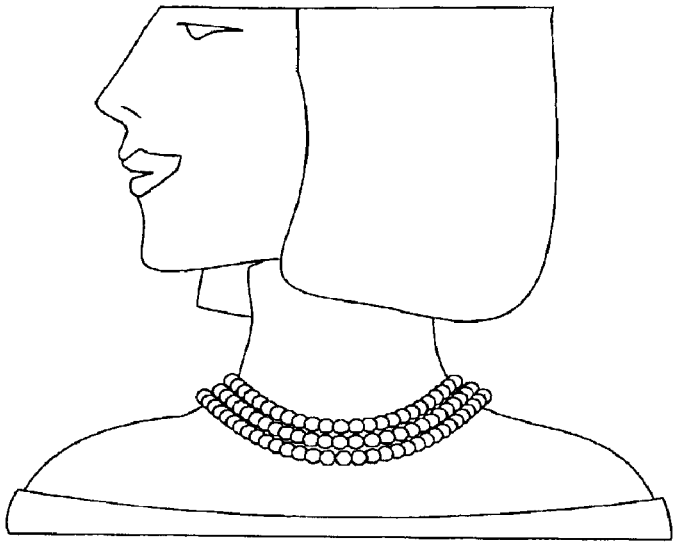
FIG. 3 is a front view of a multiple-strand choker having the strands positioned in a stacked arrangement.

Please refer to FIG. 2 which illustrates a choker using a conventional connector 36 of prior art having terminal 37 located at the longitudinal median of the connector. The lower strand 40 of the choker is longer and thus heavier than the upper stand 41, and the lower strand 40 would sag down, and pull the upper strand 41 upwards by the lever action of the connector, thus creates an undesirable gap 42 between the strands.

Figure 4A:
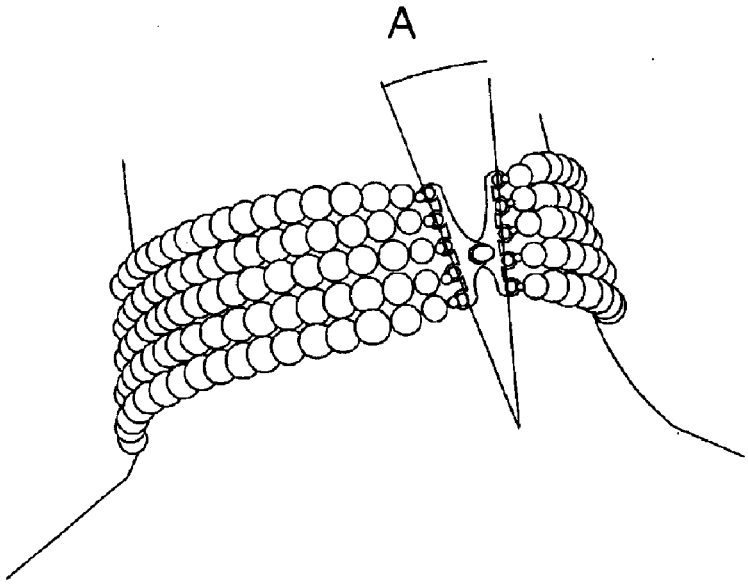
FIG. 4A is a view of one preferred embodiment of the connector of the present invention incorporated in a multiple-strand choker worn on a person, with the strands adjusted in a stacked arrangement.
Figure 4B:
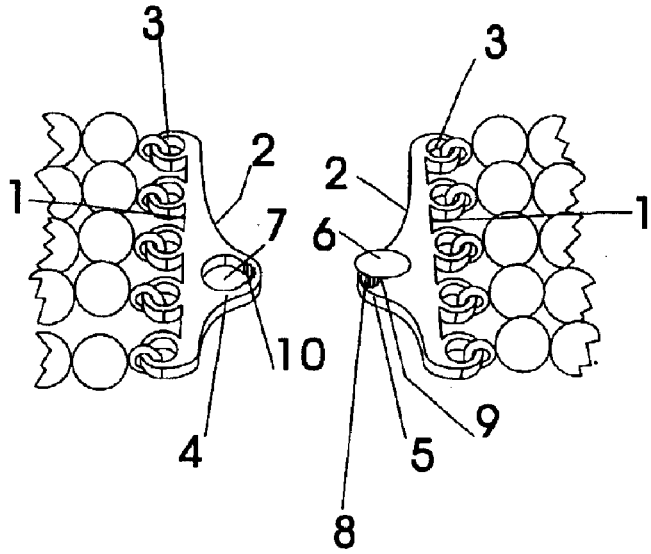
FIG. 4B is a plan view of the connectors shown in FIG. 4A.

As shown in FIGS. 4A and 4B, a preferred embodiment of the present invention consists of a first connector and a second connector, both are substantially elongated flat sheets, made from stamping a sheet of metal or lost wax casting. Each of the connectors has a front side 1 and a rear side 2. A series of eyelets 3 is laid out evenly spaced apart longitudinally along the front side 1, providing outlets to the ends of the ornamental strands. The terminals 4 and 5 extend rearwards from the rear side 2, and are positioned below the longitudinal median M of the connectors (also referring to FIG. 5), preferably at a distance no less than 0.5 mm. A hollow 7 is formed in the terminal 4 of the first connector, and a pivot 8 extends perpendicularly upwards from the terminal 5 of the second connector; a cap 6 is soldered to the top of the pivot 8; whereas the diameter of the cap 6 is larger than the pivot in the second connector, and is able to fit into the hollow 7 of the first connector, and the said hollow 7 in the first connector is engageable with the pivot 8 in the second connector. Teeth 9 are made on the perimeter of the pivot 8 and teeth 10 are also made on the perimeter of the hollow 7.

The two connectors are engaged with each other by inserting the cap 6 of second connector into the hollow 7 of the first connector. Once the hollow 7 is beneath the cap 6, the connectors are rotated relative to each other on a plane parallel to the neck to a desirable angle A as shown in FIG. 4A. Then the two connectors are pulled laterally away from each other, sliding the hollow 7 under the cap 6 until it is in contact with the pivot 8. The Teeth 9 on the perimeter of pivot 8 and the teeth 10 on the perimeter of hollow 7 interlock with each other and form the angle A which is fixed between the two connectors once the teeth 9 and 10 are interlocked.

The above-described preferred embodiment is considered as one of the most practical. However, the mechanics that enable the advantages of the present invention is more conveniently explained with another embodiment of the connectors of the present invention that is incorporated in a two-strand choker shown in FIGS. 5, 6 and 7, whereas the strands are made of the same material and have the same thickness.

Figure 5:
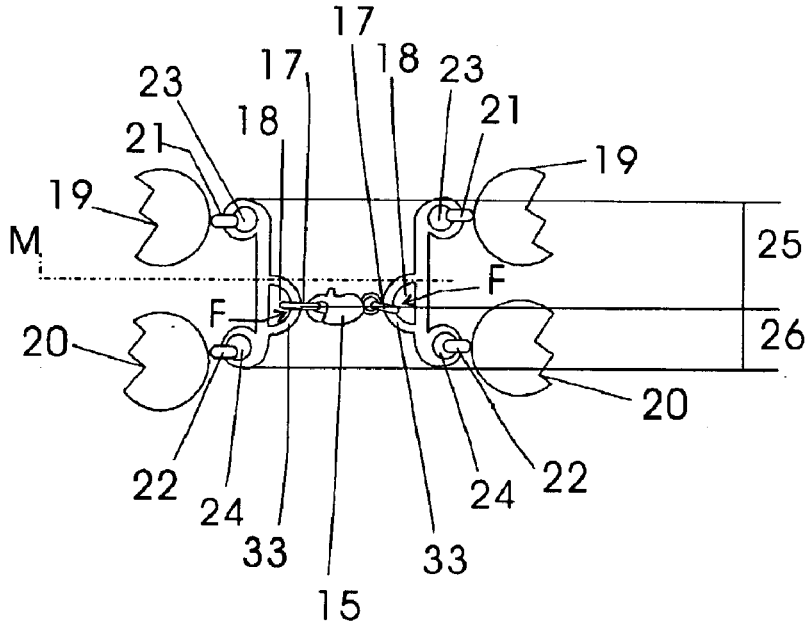
FIG. 5 is a schematic view of another preferred embodiment of the connector of present invention for a two-strand choker.

A preferred embodiment of the connector for a two-strand choker is shown in FIG. 5. A hollow 18 is formed in the terminals of both connectors, which provides link with the O-rings 17 of a clasp assembly 15, and allows the connectors to swivel on a plane parallel to the surface of the neck. Each connector has a single contact point between the terminal 33 and the O-ring 17. Thus the connectors can swivel about the contact points. The portion of the connectors above the terminals 33 in the longitudinal direction is the upper portion 25, and the portion of the connectors below the terminal 33 in the longitudinal direction is the lower portion 26.

Ends of the upper strand 21 are connected to the upper eyelet 23 located in the upper portion 25 of the connector to form an upper loop 27. Whereas the loop is the length of the strand 19 plus the space 29 between its ends when the choker is encircled about the neck. The ends of the lower strand 22 are connected to the lower eyelets 24 located in the lower portions 26 of the connectors to form a lower loop 28.

Figure 6:
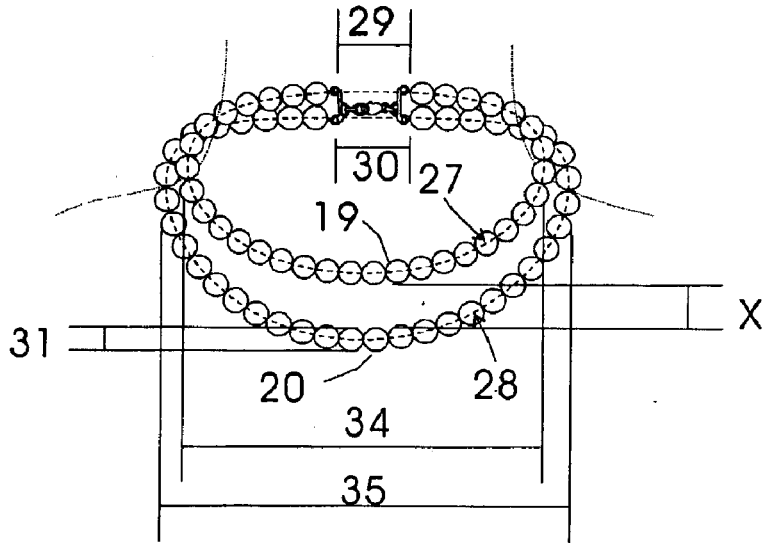
FIG. 6 illustrates the relationship of the connector of FIG. 5 with the ornamental strands in a two-strand choker.

When the choker is worn around the neck, the middle portion of the strands 34 and 35 are draped in front of the neck, applying loads to the eyelets 23 and 24 of the connectors. The clasp linked to the terminal provides an up lifting force to the connector to suspend the necklace from the back of the neck, as shown in FIG. 6. Thus, the connectors assume the functions of a first class lever, with fulcrum F located at the terminal 33, and downward loads applied to the eyelets 23 and 24. Moments applied to the eyelets are approximately proportional to the weight of the strands times the distance from their respective eyelets 23 and 24 to the fulcrum F.

Figure 7:
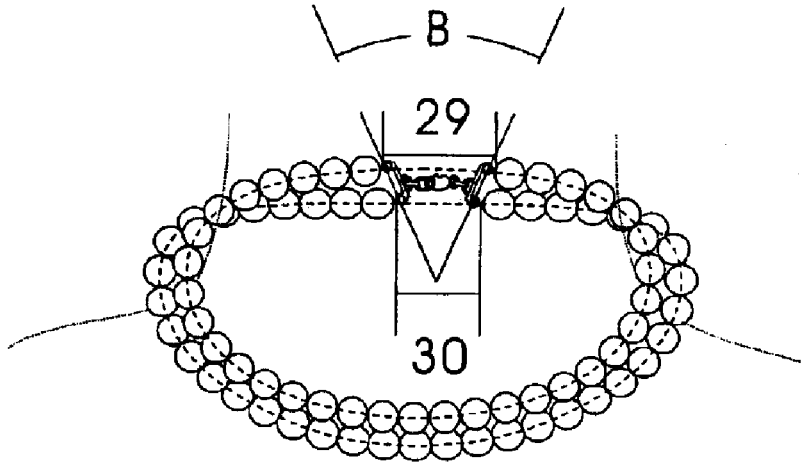
FIG. 7 shows the two-strand choker of FIG. 6 in a stacked arrangement.

The lever characteristics of the connectors can position and retain the strands in a stacked arrangement for various neck contours provided that the following conditions are met:

1. Relative circumferential length of the loops formed by each strand is adjustable;
2. The downward moment applied to the upper portions 25 of the connector is greater than the downward moment applied to the lower portions 26 when a gap X exists between the strands;
3. The strands are in a stacked arrangement when the downward moments applied to the upper portions 25 and the lower portions 26 of the connectors are balanced The first condition is met by pivoting the connectors at a single point at the terminals, thus the connectors swivel relative to each other on a plane parallel to the surface of the back of the neck. Refer to FIG. 6, a gap X exists between the strands when the connectors are parallel to each other. As the upper portions 25 of the connectors tilt away from each other, the space 29 between the ends of the upper strand 19 increases, and the circumferential length of the upper loop 27 is expanded. Accordingly, as shown in FIG. 7, the lower portions 26 of the connectors are levered towards each other, decreasing the space 30 between the ends of the lower strand 20, thus circumferential length of the lower loop 28 is contracted to establish the stacked arrangement. The strands would remain stacked provided that angle B is sustained after the choker is donned on the neck.

In order to satisfy the second and the third conditions, the terminals 33 are desirably positioned below the longitudinal median M of the connectors, as shown in FIG. 5. Even though the upper strand 19 is shorter and weighs less than the lower strand 20, a greater moment is applied to the upper portion 25 of the connectors than the lower portion 26 because the distance from the upper eyelet 23 to the fulcrum F is longer than the distance from the lower eyelet 24 to the fulcrum F.

In consequence, the middle portion 34 of the upper strand 19 slides downward, pulling the upper portion 25 of the connectors apart (also referring to FIG. 4A). Due to an equal and opposite reaction, the lower portion 26 of the connectors is tilted inward, lifting the middle portion 35 of the lower strand 20 upwards. The moments acting on the upper and lower portions 25 and 26 of the connectors are balanced when the upper strand 19 rests on the top of the lower strand 20, as shown in FIG. 7, and the lower strand 20 acts as a ledge to support the upper strand 19. Thus, the gap X between the strands is closed, and a stacked arrangement is attained.

Accordingly, stack arrangement is automatically attained for a variety of neck sizes and contours for the chokers incorporating the connector of the present invention. For example, a person with a thin neck wears a multiple-strand choker that incorporates the connector of the present invention, and the difference between the circumferential lengths of the loops is one inch when the strands are adjusted to a stacked arrangement. When another person with a thicker neck wears the same choker, the difference required is reduced to half an inch; thus an undesirable gap X is formed as shown in FIG. 6. However, when the present invention is adopted, the upper strand 19 would slide down towards to the lower strand 20 because of the greater moment applied to the upper portion 25 of the connector, thus pulling the upper portions 25 of the connectors apart, and adding length to the upper loop 27. Meanwhile the lower portion 26 of the connector are tilted inward, decreasing the length of the lower loop 28, and the difference in length of the upper loop 27 and the lower loop 28 is reduced to half an inch, and the stacked arrangement is attained.

The advantages of the connector of the present invention described above are also applicable in adjusting chokers containing more than two ornamental strands to establish the stacked arrangement. As long as the down-pull moment acting on the upper potion of the connector is greater than the lower portion, the lifting force applied to the strands decreases progressively from the bottom strand to the top strand, and each strand can act as a ledge for its upper strand to establish the stacked arrangement.

Figure 8:
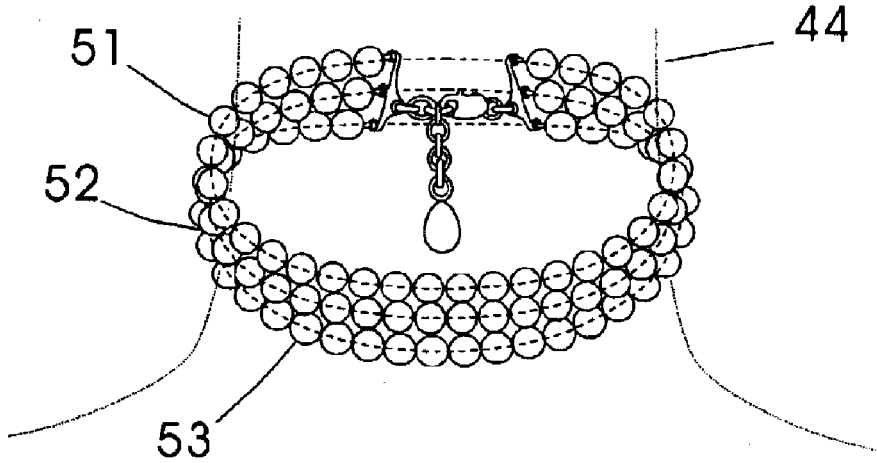
FIG. 8 is a front view of the a collar type multiple-strand choker.
Figure 9:
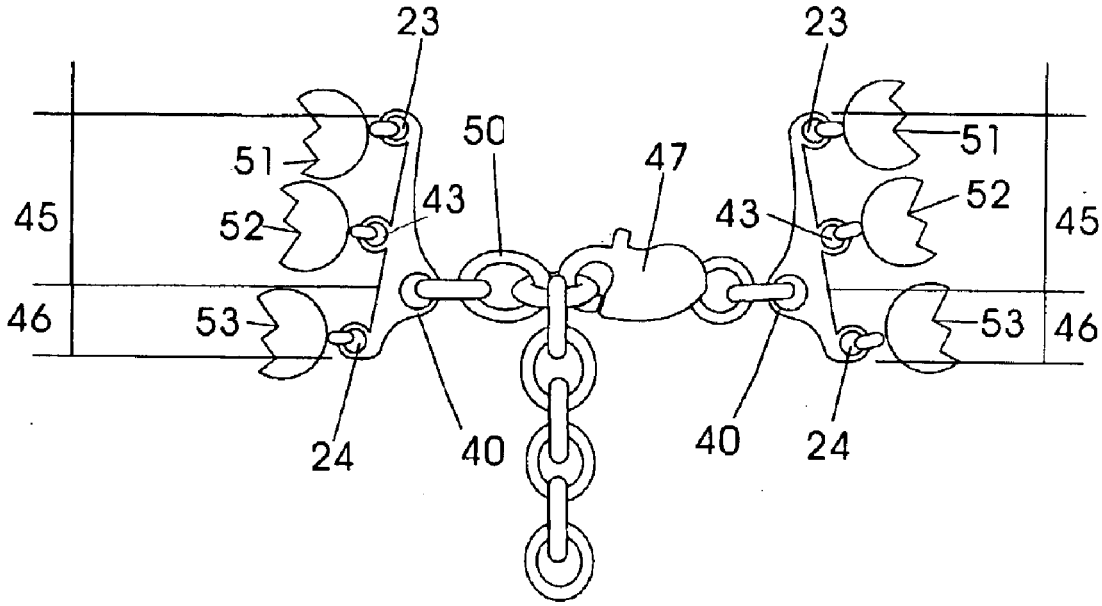
FIG. 9 shows another preferred embodiment of the connector of the present invention designed for the multiple-strand choker shown in FIG. 8.

FIG. 8 illustrates the application of a preferred embodiment of the connector of present invention in a three-strand "collar" type choker. Collars are approximately 12 to 14 inches long, worn high around the throat. By means of the invention, the top strand 51 can be stacked on the middle strand 52 which in turn can be stacked on the bottom strand 53. As a result, the collar can fit snugly and comfortably around the wearer's neck, and does not slip down. A preferred embodiment of the connector is shown in FIG. 9. The terminals 40 are located on the rear sides of the connectors, horizontally across a point between the middle eyelet 43 and the lower eyelet 24. An extender 50 is attached to the terminal 40 of one of the connectors to accommodate various neck sizes, and a conventionally available clasp 47 is linked to the other connector.

Other than gravity, the strands in the collar are also subject to the pressure force imposed by the contour of the neck directing perpendicularly outwards from the surface of the neck 44, and the friction force parallel to the surface of the neck 44. In fact, the loads applied to the connecters in a collar choker primarily come from the neck-to-strand pressure, not the weight of the strands.

When donning a collar that incorporates the preferred embodiment of the connector of the present invention, the wearer lifts the bottom strand 53 to the position of the neck 44 where the top strand 51 is intended to be worn, brings the terminal 40 of the connectors as closely to each other as possible, hooks the clasp 47 assembly to the appropriate link in the extender 50, then let the collar to slide down the neck 44. Subsequently, lower portions 46 of the connectors spread apart. As the bottom strand 53 expands its loop to fit the neck 44 circumference, and the upper portions 45 of the connectors are levered inward, the top strand 51 and the middle strand 52 are pulled against the surface of the neck 44.

When the bottom strand 53 slides down along the surface of the neck 44, the neck-to-strand pressure gradually increases, inducing friction between the bottom strand 53 and the surface of the neck 44. The collar stops sliding down when the friction becomes sufficiently great to support the weight of the entire choker, thus the bottom strand acts as a ledge to support the weight of the top and the middle strands 51 and 52.

Based on the calculation of the loads required to balance the connectors, the neck-to-strand pressure at the bottom strand 53 is estimated approximately twice the pressure of the middle strand 52 and four times the pressure of the top strand 51. Thus, friction on the surface of the neck 44 decreases progressively from the bottom strand 53 to the top strand 51, and the top strand 51 and the middle strand 52 slide down along the surface the neck 44 and rest on the strand underneath to facilitate an stacked arrangement.

Accordingly, the top strand 51 is most susceptible to relax from the neck 44 when the wearer engages in vigorous physical activities. As the top strand 51 relaxes, lever action of the connectors would pull the bottom strand 53 tighter against the neck 44. Thus, the choker does not slide down further. The top strand 51 is pulled back against the neck 44 and slide down to rest on top of the middle strand 52 to resume the stacked arrangement when the wearer is at a resting position.

Based on experiences, a collar incorporating the connector of the present invention is much more comfortable to wear than conventional collars because no elastic means is used to prevent the choker from sliding down. The middle and the top strands 52 and 51 are loosely fasten to the upper portions 45 of the neck 44, thus the wearer does not feel stifling around the throat or constraint when the neck 44 is moved.

Figure 10:
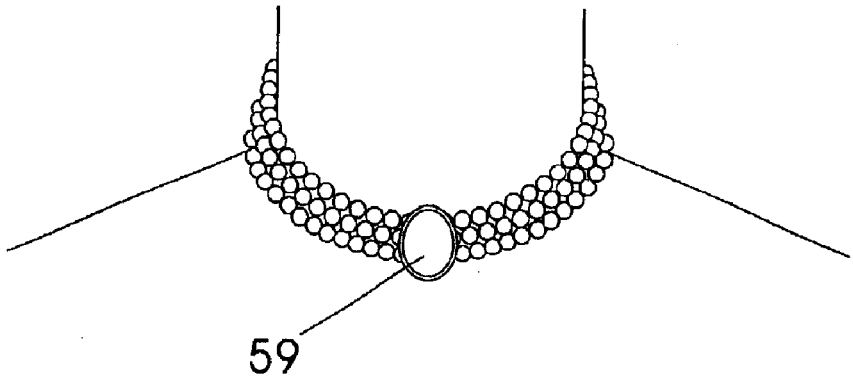
FIG. 10 shows a pendent connected to a multiple-strand choker.
Figure 11:
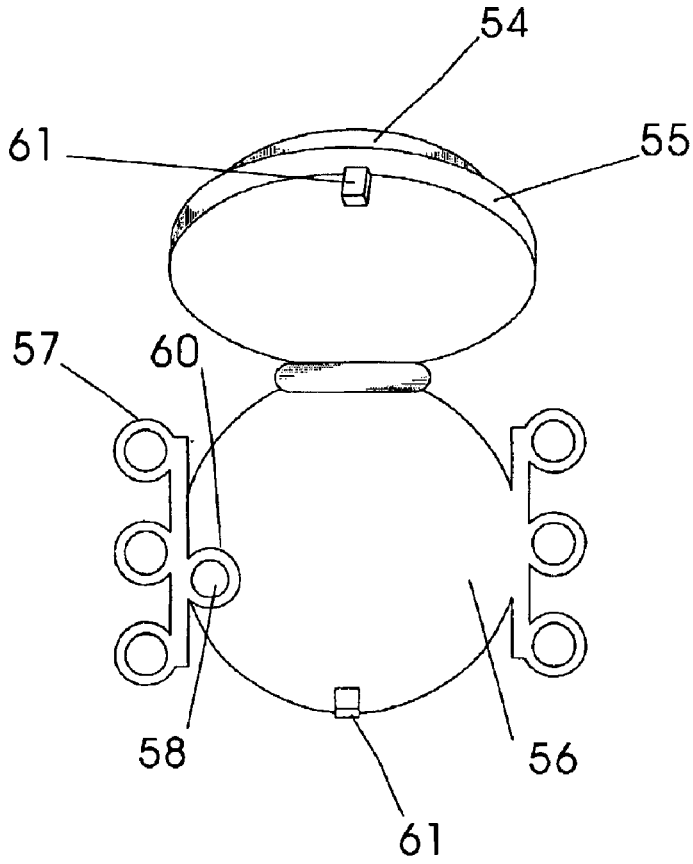
FIG. 11 is a schematic view of a preferred embodiment of the connector of the present invention incorporated in the pendant shown in FIG. 10.

When a connector of the present invention is incorporated in a pendant 59 that links to a plurality of ornamental strands, it also facilitates the advantages of fitting various neck sizes and keeping the strands in an stacked arrangement as shown in FIG. 10. A preferred embodiment for this application is shown in FIG. 11. Base plate portion 56 of the pendant has a series of outlets on the right-hand-side for linkage to ornamental strands. Terminal 60 of a connector 57 according to the present invention is pivoted to the left-hand-side of the base plate portion 56, whereas the terminal is positioned below the longitudinal median of connector 57. The connector 57 is swivelable relative to the base plate portion 56 about the pivot 58. Cover portion 55 of the pendant is embellished with a piece of gemstone 54 or other ornaments, and hinged to the base plate portion 56. The cover portion 55 can be opened or closed to the base plate portion 56 through a set of clips 61.

Figure 12:
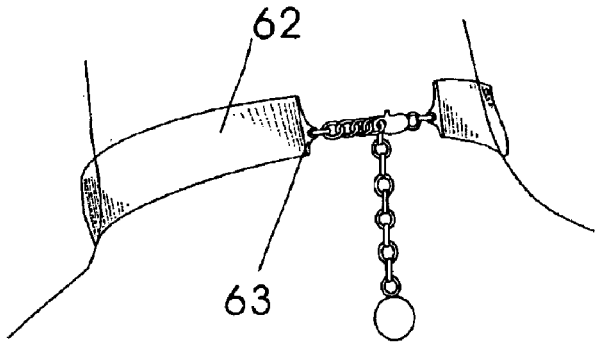
FIG. 12 is a schematic view of another preferred embodiment of the connector of the present invention incorporated in a mesh collar.

FIG. 12 illustrates the incorporation of the connector 63 of the present invention on a collar with an ornamental portion made up of a mesh 62. The advantage of using the connector of the present invention in this type of collar is that less tension is required to prevent the mesh from sliding down in comparison to prior art connectors that have terminals located at their longitudinal medians. The connector distributes the greatest tension to the lower portion of the mesh 62, thus induces sufficient friction on the lower portion of the neck to resist sliding. The upper portion of the mesh 62 would fit snugly about the neck with support from the material underneath by the same mechanism as explained in collars made of multiple strands of beads.

Figure 13:
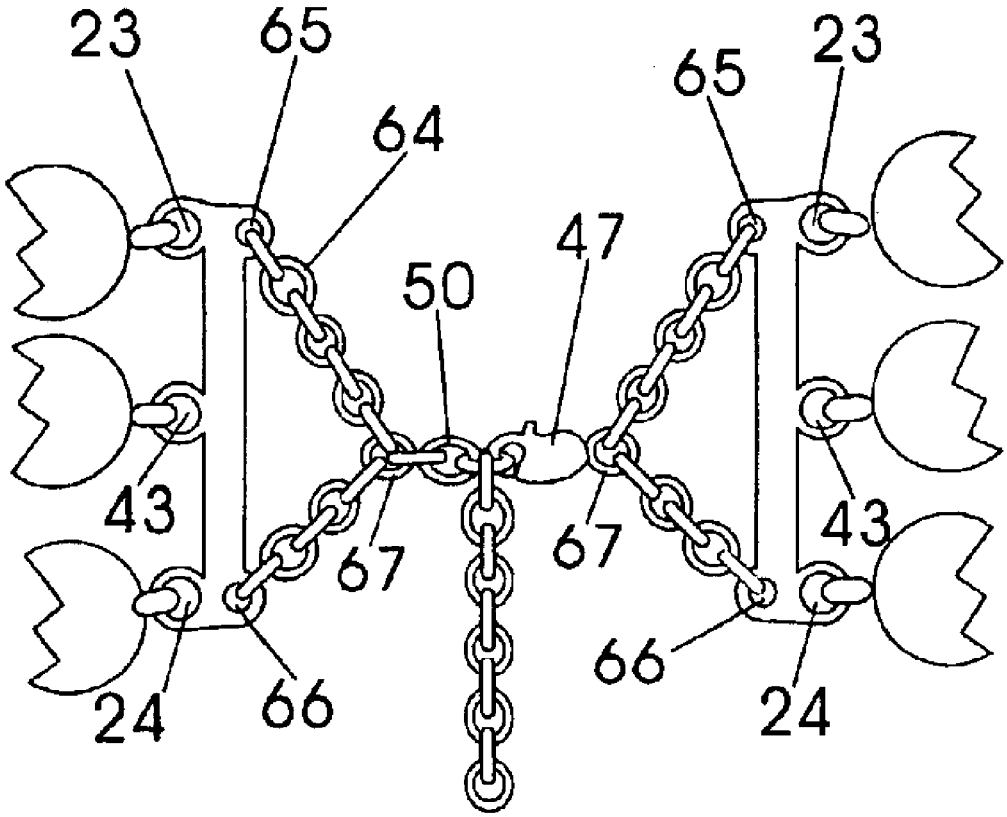
FIG. 13 is a schematic view of yet another preferred embodiment of the connector of the present invention designed for the multiple-strand choker shown in FIG. 8.

FIG. 13 illustrates yet another embodiment of the present invention that is largely constructed like the one shown in FIG. 9. However, instead of the terminals 40 formed on the rear side of the first and the second connectors, the rear side of the first and the second connector in this embodiment has an upper aperture 65 formed on the upper end and a lower aperture 66 formed on a lower end. And a flexible chain 64 has two ends engaged respectively with the upper aperture 65 and the lower aperture 66. Like the embodiment shown in FIG. 9, an extender 50 is attached to the chain 64 of the first connector to accommodate various neck sizes, and a conventionally available clasp 47 is linked to the other chain 64 of the second connector. The extender 50 and the clasp 47 are engaged respectively with a contact O-ring 67 of the chains 64. The contact O-ring 67 is located at a longitudinal position between the middle eyelet 43 and the lower eyelet 24, and is below the longitudinal median of the connectors, preferably at a distance no less than 0.5 mm.

For the purpose of providing specifications to the designing and manufacturing of chokers that incorporate the connector of the present invention, a guideline for selecting the length for the strands of various thickness is provided as follows to optimize the advantages of this invention.

Chokers having the top strand 15 to 18 inches long inclusive designed for people having 12 to 14 inch circumference measured at the base of the neck, length of the strands increases progressively from top to bottom at the interval of four times the thickness of the strands.

Collar chokers having the bottom strand less than 12 inches long designed for the same people, length of the strands decreases progressively from bottom to top at the interval of one times the thickness of the strands.

For example, for a three-strand choker with the top strand of sixteen-inch long and one-quarter inch thick, the middle strand is seventeen inches long, and the bottom strand is eighteen inches long. And, for a three-strand collar with the bottom strand of eleven-inch long and one-quarter inch thick, the middle strand is ten and three-quarter inch long and the top strand is ten and one-half inch long.

Minuteness of the alteration in the construction of the connectors according to the present invention will be appreciated by those skilled in the art, because the connectors in existing multiple-strand chokers can be easily replaced with one made according to the present invention, and significant improves the chokers' wearability, and can be made available to a greater population of wearers with various neck sizes and contours.

Furthermore, various changes and modifications can be readily made to the connector in accordance to the aesthetic or functional requirements without departing from the principles of this invention. Therefore, the appended claims are intended to cover all embodiments, which do not depart from the spirit and scope of the present invention.

What is claimed is:

1. A connecting structure for a multiple-strand jewelry having a plurality of parallel aligned ornamental strands, comprising:

a first connector having a first side and a second side for engagement with first distal ends of the multiple-strand jewelry; and a second connector removably engages with the first connector via a fastener, the second connector having a first side and a second side for engagement with second distal ends of the multiple-strand jewelry, wherein the first connector comprises:

(a) a terminal formed on the first side, (b) the second side, opposite to the first side, having at least two longitudinally aligned and evenly distributed outlets for gathering first distal ends of the ornamental strands, (c) a top end defined by an uppermost outlet for attachment with a first distal end of an uppermost ornamental strand, (d) a bottom end defined by a lowermost outlet for attachment with a first distal end of a lowermost ornamental strand, (e) a surface plane extending from the first side to the second side, wherein (1) said terminal on the first side is a hollow bored perpendicularly to the surface plane and positioned entirely below a median, wherein the median is an imaginary plane that perpendicularly bisects a linear distance between the top end and the bottom end of the first connector, and the terminal is adapted to pivotally engage the fastener which links to the second connector for encirclement, and the said first connector is rotatable with respect to the terminal and parallel to the surface plane when the jewelry is in use, (2) moment about the terminal, when the necklace is in use, progressively increases from the lowermost outlet to the uppermost outlet along the second side of the first connector, thereby retaining the strands in a stacked arrangement.

2. The connecting structure for the multiple-strand jewelry of claim 1, wherein the terminal of the first connector is pivot extending perpendicularly to the surface plane and positioned entirely below the median.

3. The connecting structure for the multiple-strand jewelry of claim 1, wherein the terminal of the first connector is a male portion of a fastener, and the terminal of the second connector is a female portion of the fastener, the male portion of the first connector is removably engageable with the female portion of the second connector to combine the first connector and the second connector.

4. A connector structure in combination with a multiple strand jewelry having a plurality of parallel aligned ornamental strands, the connector structure comprising:

a first connector having a first side and a second side to engage with first distal ends of the multiple-strand jewelry, and a second connector in connection with the first connector via a fastener, the second connector having a first side and a second side to engage with second distal ends of the multiple-strand jewelry, wherein the first connector comprises:

(a) a terminal formed on the first side, (b) the second side, opposite to the first side, having at least two longitudinally aligned and evenly distributed outlets for gathering first distal ends of the ornamental strands, (c) a top end defined by an uppermost outlet to attach with a first distal end of an uppermost ornamental strand, (d) a bottom end defined by a lowermost outlet to attach with a first distal end of a lowermost ornamental strand, (e) a surface plane extending from the first side to the second side, wherein (1) said terminal on the first side is a hollow bored perpendicularly to the surface plane and positioned entirely below a median, wherein the median is an imaginary plane that perpendicularly bisects a linear distance between the top end and the bottom end of the first connector, and the terminal is adapted to pivotally and removably engage the fastener which connects to the second connector for encirclement, and the said first connector is rotatable with respect to the terminal and parallel to the surface plane when the jewelry is in use, (2) moment about the terminal, when the necklace is in use, progressively increases from the lowermost outlet to the uppermost outlet along the second side of the first connector, thereby retaining the strands in a stacked arrangement.

5. The connecting structure for the multiple-strand jewelry of claim 4, wherein the terminal of the first connector is a male portion of a fastener, and the terminal of the second connector is a female portion of the fastener, the male portion of the first connector is engageable with the female portion of the second connector to combine the first connector and the second connector.

6. The connecting structure for the multiple-strand jewelry of claim 5, wherein the first connector and the second connector are connected to each other via a pendant.

* * * * *